US006070541A

United States Patent [19]

Kinoshita et al.

[11] Patent Number: 6,070,541

[45] Date of Patent: Jun. 6, 2000

[54] OVEREDGE SEWING MACHINE WITH MOVABLE NEEDLE PLATE PARTS

[75] Inventors: Katsutoshi Kinoshita; Kazuhiro Okuda, both of Tokyo, Japan

[73] Assignee: Juki Corporation, Chofu, Japan

[21] Appl. No.: 08/951,237

[22] Filed: Oct. 16, 1997

[30] Foreign Application Priority Data

Oct. 17, 1996 [JP] Japan ..... 8-295791

[51] Int. Cl.[7] ..... D05B 1/20

[52] U.S. Cl. ..... 112/162; 112/165; 112/168

[58] Field of Search ..... 112/162, 163, 112/165, 166, 167, 168, 197, 235, 260

[56] References Cited

U.S. PATENT DOCUMENTS

| | | | |
|---|---|---|---|
| 4,356,782 | 11/1982 | Ueyama et al. | 112/197 |
| 4,690,080 | 9/1987 | Mikuni et al. | 112/162 |
| 5,216,970 | 6/1993 | Sakuma | 112/168 |
| 5,467,725 | 11/1995 | Fujita et al. | 112/162 |
| 5,503,094 | 4/1996 | Tseng | 112/165 X |
| 5,529,003 | 6/1996 | Kojima et al. | 112/168 |

FOREIGN PATENT DOCUMENTS

| | | |
|---|---|---|
| 7-31760 | of 1995 | Japan . |
| 8-131680 | of 1996 | Japan . |
| 135183 | 11/1990 | Taiwan . |
| 249252 | 11/1995 | Taiwan . |
| 254306 | 11/1995 | Taiwan . |
| WO 93/24697 | 12/1993 | WIPO . |

*Primary Examiner*—Ismael Izaguirre
*Attorney, Agent, or Firm*—Morgan & Finnegan, L.L.P.

[57] ABSTRACT

A overedge sewing machine comprises: drive mechanisms for selectively carrying out a hemstitch sewing operation and flat stitch and double-chain stitch sewing operations; a needle plate having a stitch finger, a guide needle piece and a stitch tongue reciprocatable between an operation position and a non-operation position outside the needle plate claw and guide needle; and three needles mounted removably thereon in such a manner that the three needles are arranged in parallel to each other substantially on a straight line, wherein a needle point which is used in common with the overedge sewing operation and the flat stitch and double-chain stitch sewing operations is positioned between the stitch tongue and the guide needle piece respectively provided in the needle plate.

9 Claims, 10 Drawing Sheets

FIG.10

| TYPE | POSITION | STITCH TYPE | SEAMS |
|---|---|---|---|
| HEMI STITCH | | ① ONE-NEEDLE TWO-THREAD LOCK STITCH<br>② ONE-NEEDLE TWO-THREAD FINE LOCK STITCH<br>③ ONE-NEEDLE TWO-THREAD WHOLE ROUND STITCH<br>④ ONE-NEEDLE TWO-THREAD OPEN LOCK STITCH<br>⑤ ONE-NEEDLE THREE-THREAD LOCK STITCH<br>⑥ ONE-NEEDLE THREE-THREAD FINE LOCK STITCH<br>⑦ ONE-NEEDLE THREE-THREAD WHOLE ROUND LOCK STITCH<br>⑧ ONE-NEEDLE THREE-THREAD OPEN STITCH<br>⑨ TWO-NEEDLE FOUR-THREAD LOCK STITCH | OMIT |
| | | ⑩ THREE-NEEDLE FIVE-THREAD LOCK STITCH | |
| FLAT STITCH | | ⑪ THREE-NEEDLE FLAT STITCH | |
| | | ⑫ TWO-NEEDLE FLAT STITCH | |
| | | ⑬ TWO-NEEDLE FLAT STITCH (SMALL WIDTH) | |
| DOUBLE-CHAIN STITCH | | ⑭ DOUBLE-CHAIN STITCH | |

OVEREDGE SEWING MACHINE WITH MOVABLE NEEDLE PLATE PARTS

BACKGROUND OF THE INVENTION

The present invention relates to a overedge sewing machine which is capable of executing not only overedge sewing but also flat stitch and double-chain stitch while switching them over to each other.

Conventionally, there has been developed a overedge sewing machine which is capable of flat stitch sewing and double-chain stitch sewing. Generally, to execute the flat stitch sewing, a needle plate must have a specific shape and also there is necessary a double-chain looper which operates separately from upper and lower loopers used to execute overedge sewing. And, a position, where a needle used to carry out the flat sewing operation and double-chain stitch sewing operation is moved vertically, is set such that it is shifted respectively right and left as well as back and forth in a cloth feeding direction with respect to the overedge sewing operation. For this reason, when carrying out the flat stitch sewing operation and double-stitch sewing operation, it is necessary to change the needle to a position different from a position which is used in the overedge sewing operation.

However, use of the structure requiring the abovementioned needle position change results in not only the complicated and large-sized sewing machine but also the poor efficiency of the operation thereof. In view of this, in order to improve them, as in a sewing machine which is disclosed in Japanese Patent Publication No. 07-112517 (U.S. Pat. No. 4,690,080) there is developed a sewing machine which can use a lower looper and a double-chain looper in combination by switching a drive mechanism, thereby being able to omit the above-mentioned change of the needle position.

However, even in such sewing-machine, a needle plate must be replaced between the overedge sewing operation and the flat stitch and double-chain stitch sewing operations. That is, due to the fact that, especially in executing the flat stitch sewing operation, the needle setting portion of the needle plate must have a specific shape, the needle plate must be replaced with an exclusively designed needle plate.

SUMMARY OF THE INVENTION

Accordingly, it is an object of the invention to provide a overedge sewing machine which eliminates the need for replacement of the needle and is capable of executing not only the overedge sewing operation but also the flat stitch sewing and double-chain stitch sewing operations.

According to one aspect of the invention, there is provided a overedge sewing machine comprising: means for switching between a hemstitch sewing operation and flat stitch and double-chain stitch sewing operations; a needle plate having a stitch finger, a guide needle piece and a stitch tongue reciprocatable between an operation position and a non-operation position outside the needle plate claw and guide needle; and three needles mounted removably thereon in such a manner that the three needles are arranged in parallel to each other substantially on a straight line, wherein a needle point which is used in common with the overedge sewing operation and the flat stitch and double-chain stitch sewing operations is positioned between the stitch tongue and the guide needle piece respectively provided in the needle plate.

According to a second aspect of the invention, there is provided the overedge sewing machine of the first aspect of the invention, wherein the stitch tongue is formed such that it moves around the needle point provided between the stitch tongue and the guide needle piece.

According to a third aspect of the invention, there is provided the overedge sewing machine of the first aspect, further comprising a cloth presser member which is used to press against the respective peripheries of the three needles.

According to a fourth aspect of the invention, there is provided the overedge sewing machine of the first aspect, further comprising a flat stitch sewing thread guide claw which is used to increase the winding amount of a lower thread.

According to a fifth aspect of the invention, there is provided the overedge sewing machine of the fourth aspect, wherein the flat stitch sewing thread guide claw is disposed such that it can advance into and retreat from a needle falling area on the lower side of at least one of a round stitch sewing needle plate claw and the wound stitch sewing guide needle.

According to the present invention thus constructed, the overedge sewing operation and the flat stitch and double-chain stitch sewing operations can be executed at the same needle position without replacing the needle position.

Also, especially as in the fourth aspect of the invention, if there is provided the flat stitch sewing thread guide claw for increasing the winding amount of the lower thread, then a sewing operation can be executed with the lower thread loosened so that the feeling of the flat stitch sewing can be improved.

BRIEF DESCRIPTION OF THE DRAWINGS

FIG. 7 is an explanatory plan view of a thread slide piece employed in the invention, showing a state in which the thread slide piece is drawn in;

FIG. 10 is an explanatory view of types of stitches and seams which can be executed by a overedge sewing machine according to the invention;

DETAILED DESCRIPTION OF THE PREFERRED EMBODIMENTS

Now, description will be given below in detail of the embodiments of a overedge sewing machine according to the invention with reference to the accompanying drawings.

Figure 1:
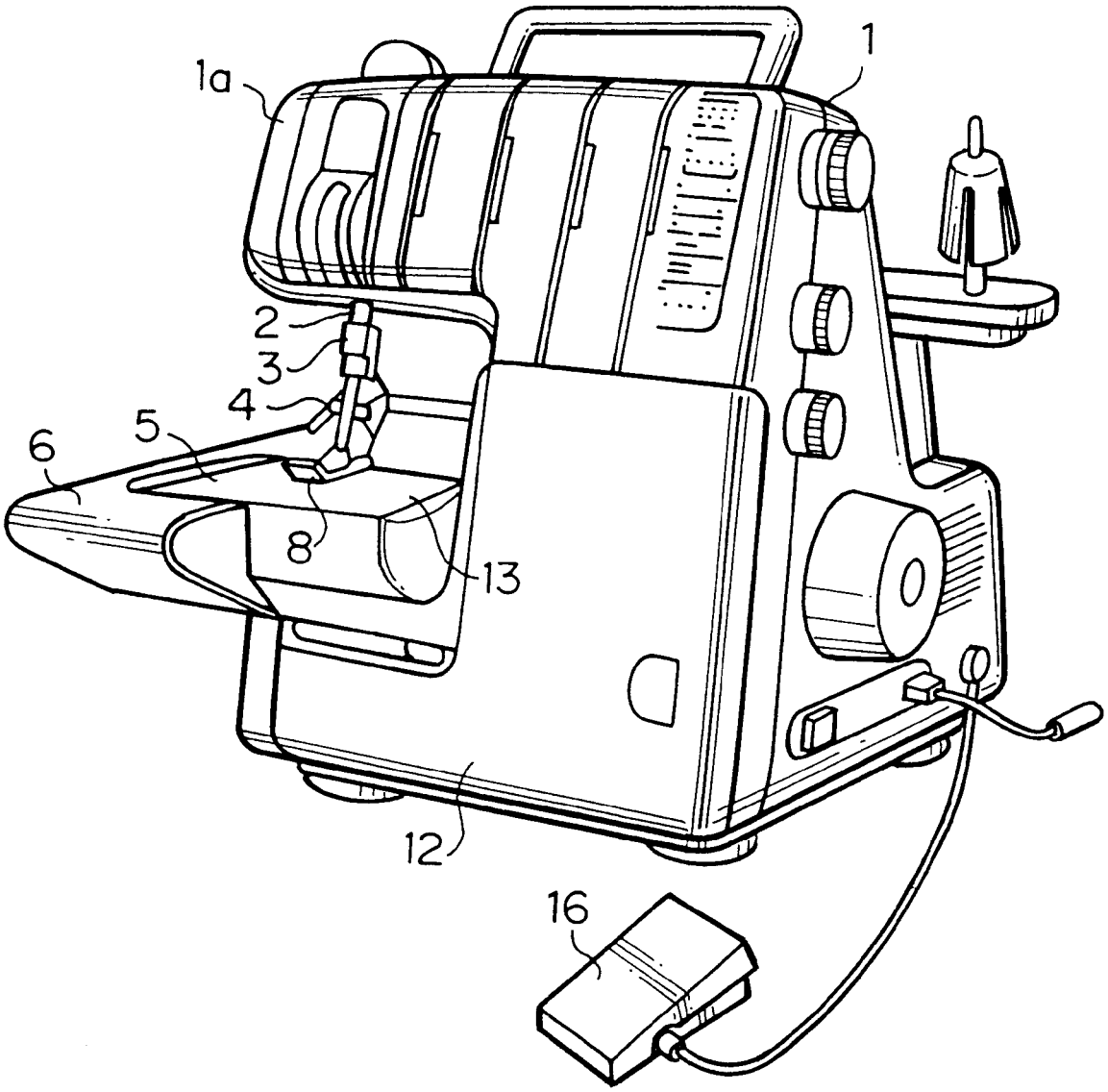
FIG. 1 is a perspective view of the outer appearance of a overedge sewing machine according to the invention, explaining an embodiment to execute flat stitch and double-chain stitch sewing operations.
Figure 2:
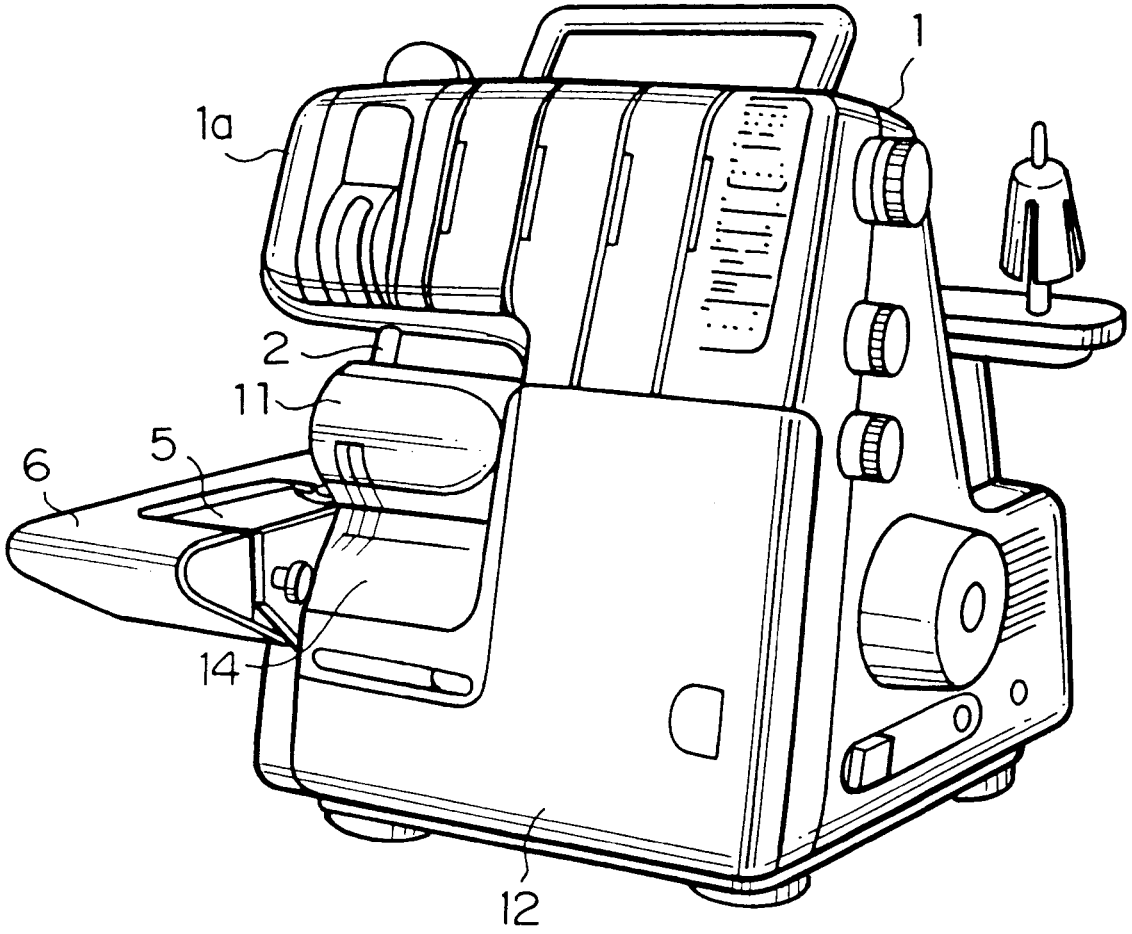
FIG. 2 is a perspective view of the outer appearance of the overedge sewing machine shown in FIG. 1, explaining an embodiment to execute a overedgeing operation.
Figure 3:
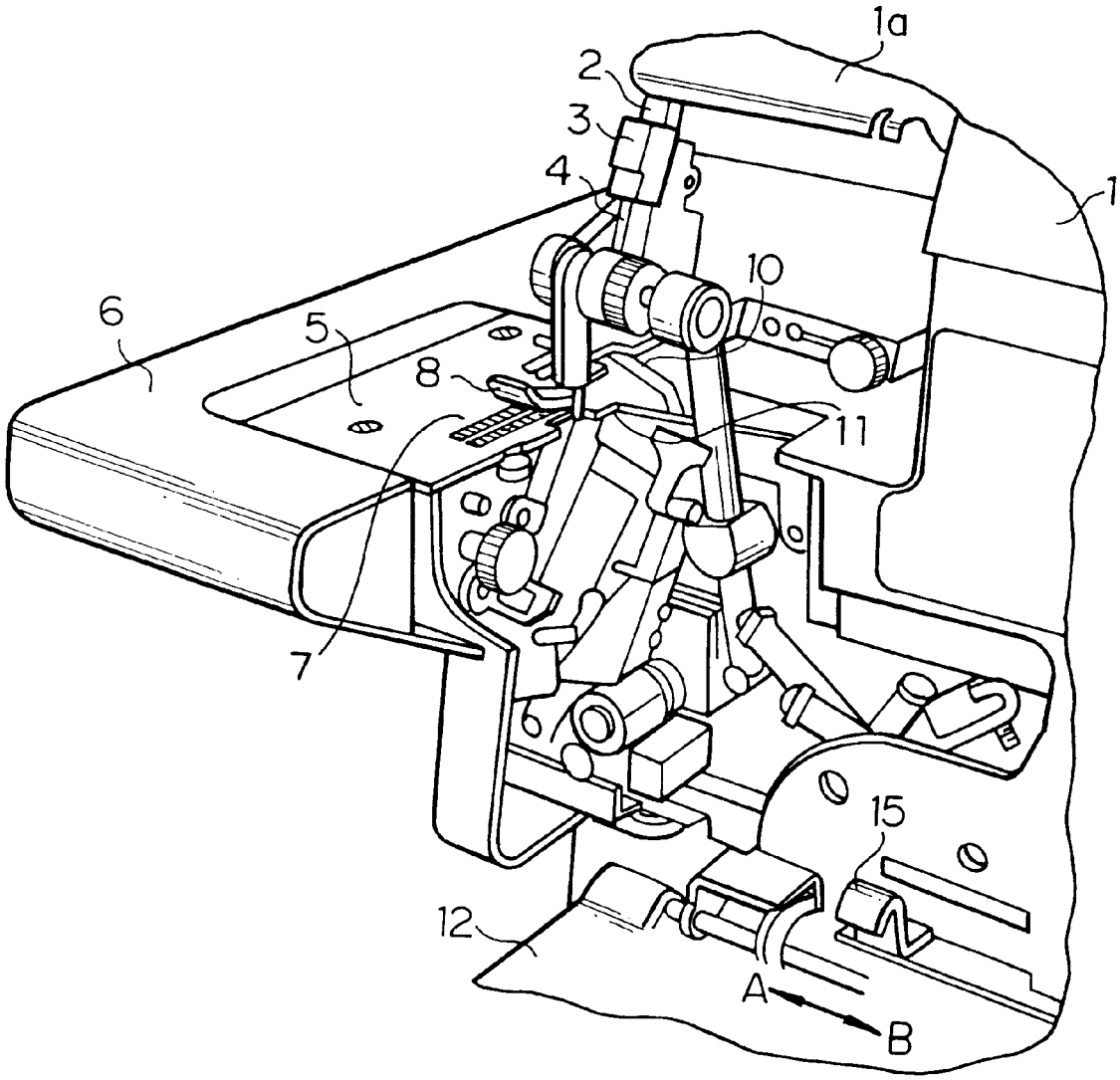
FIG. 3 is a perspective view of the outer appearance of the overedge sewing machine shown in FIGS. 1 and 2, showing the neighborhood of needle falling portions thereof in an enlarged manner.

In a overedge sewing machine shown in FIGS. 1 to 3, a needle 4 is removably mounted through a needle clamp 3 on the lower end of a needle pin which is disposed in the head portion 1*a* of a sewing machine frame 1, and a cloth plate 6 is removably disposed in the periphery of a needle plate 5. Also, just above a feed dog which is disposed such that it upwardly exposes from the needle plate 5, there is disposed a presser foot 8 which can be moved in the vertical direction so that it can be contacted with and detached from the needle plate 5.

Also, upper and lower loopers 10 and 11, as known well, are disposed such that they carry out their respective given sewing operations above and below the needle plate 5, and a looper cover 12 for covering the upper and lower loopers 10 and 11 is mounted non the front surface side of the sewing machine in such a manner that it can be freely opened and closed. On the looper cover 12, there can be mounted selectively an auxiliary bed 13 (see FIG. 1) which corresponds to the flat stitch sewing and double-chain stitch sewing operations or a cloth waste cover 14 (see FIG. 2) which corresponds to the overedge sewing operation.

Further, as shown especially in FIG. 3, a switch lever 15 used to switch the sewing operations over to each other is disposed in the lower portion o f the front face of the sewing machine frame 1 in such a manner that it can slide in the right and left direction between a position A shown left in FIG. 3 and a position B shown right in FIG. 3. The position A is a switching position which is used to select, for example, the overedge sewing operation and, if the switch lever 15 is moved to the position A side, then the upper and lower loopers 10 and 11 are allowed to execute their respective given operations for the overedge sewing. Also, the position B is a switching position which is used to select, for example, the flat stitch sewing and double-chain stitch sewing operations and, if the switch lever 15 is moved to the position B side, then the upper looper 10 is caused to stop its movement and wait at a given position, whereas a longitudinal direction operation necessary to carry out the flat stitch and double-chain stitch sewing operations is added to the lower looper 11, so that the lower looper 11 is allowed to make an elliptical motion. By the way, since a drive mechanism for such upper and lower loopers 10 and 11 as well as a switching mechanism thereof are well known, the concrete structural description thereof is omitted here.

In addition, in the sewing machine frame 1, there are incorporated a sewing machine motor (not shown) serving as a drive source and a needle drive mechanism (not shown) to be driven by the sewing machine motor, and the driving and stopping of the sewing machine motor can be controlled by a controller 16 (see FIG. 1) which is connected to the sewing machine frame 1.

Figure 4A:
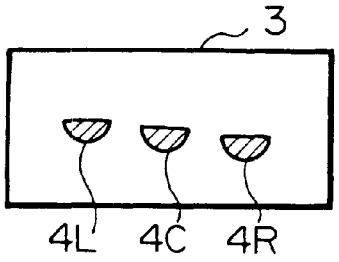
FIGS. 4(*a*) and 4(*b*) are view of the structures of a needle and a needle clamp employed in the invention; in particular, FIG. 4 (*a*) is an explanatory plan view thereof, and FIG. 4(*b*) is an explanatory front view thereof.
Figure 4B:
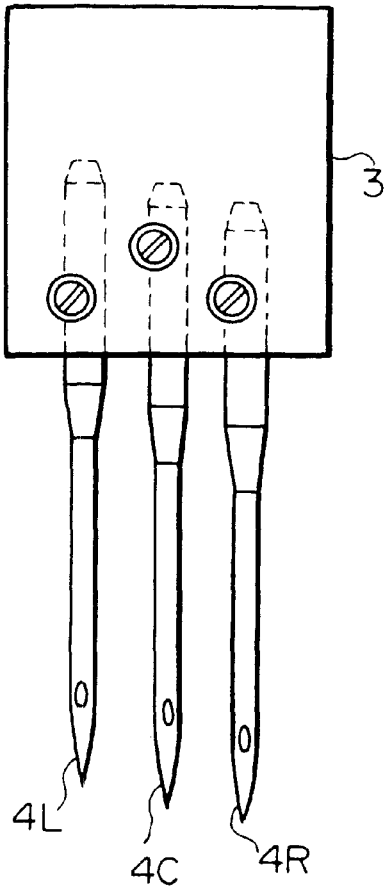

Here, referring to the needle 4 mounted on the needle clamp 3, as shown especially in FIG. 4, three needles 4 are mounted substantially on a straight line according to the locus of the elliptical motion of the lower looper 11. In particular, the three needles 4 consist of a left needle 4L, a center needle 4C and a right needle 4R, while they are structured such that they can be mounted onto and removed from the needle clamp 3 individually.

Figure 5:
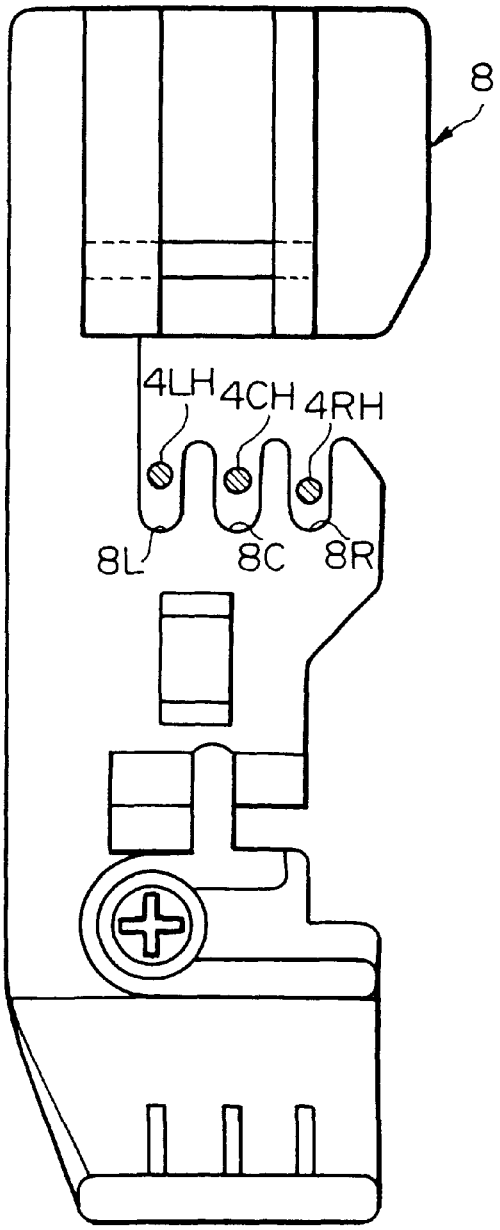
FIG. 5 is an explanatory plan view of a cloth holding structure employed in the invention.

And, as shown in FIG. 5, the three needles 4L, 4C and 4R respectively have needle points 4LH, 4CH and 4RH, while the presser foot 8 is set such that the shape thereof corresponds to these needle points 4LH, 4CH and 4RH. That is, in the presser foot 8, there are provided three notched portions 8L, 8C and 8R which are respectively formed substantially in a U shape such that they are able to hold the peripheries of the respective needle points 4LH, 4CH and 4RH. These three notched portions 8L, 8C and 8R are also arranged in parallel to the arranged direction of the needles 4L, 4C and 4R, respectively.

Figure 6A:
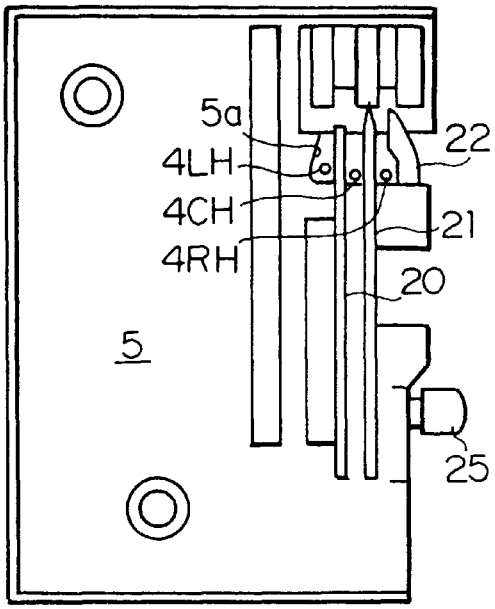
FIGS. 6(*a*) and 6(*b*) are view of the structure of a needle plate employed in the invention; in particular, FIG. 6(*a*) is an explanatory plan view thereof and FIG. 6(*b*) is an explanatory bottom view thereof.
Figure 6B:
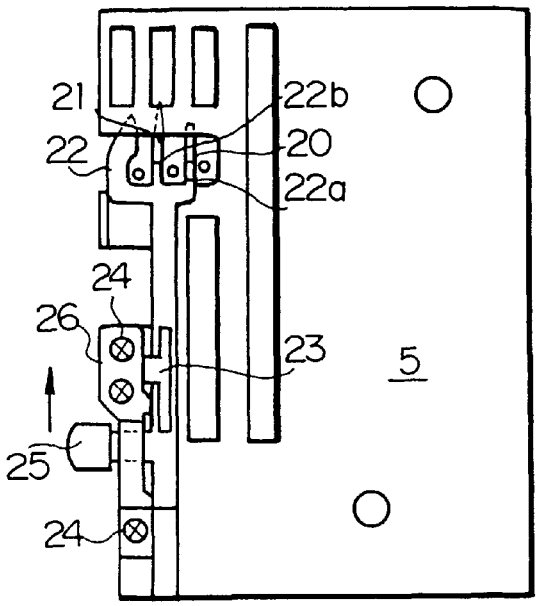
Figure 7:
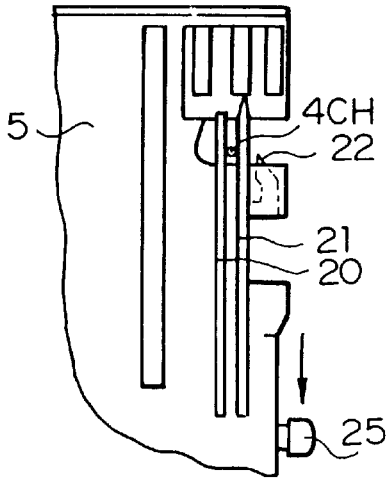

On the other hand, as shown in FIGS. 6 and 7, the needle plate 5 includes a notched portion 5*a* which is formed substantially in a U shape extending long from side to side so that it can receive the whole of the three needle points 4LH, 4CH and 4RH respectively corresponding to the three needles 4L, 4C and 4R In the sideways long needle falling area that is defined by the notched portion 5*a*, there are provided a stitch finger 20 for overedge sewing, a guide needle piece 21 for round stitch sewing, and a stitch tongue 22 for overedge sewing in such a manner that they are arranged in parallel to the arranged direction of the three needle points 4LH, 4CH and 4RH respectively.

The three members 20, 21 and 22 respectively extend along the cloth feed direction at given intervals from each other. In particular, the stitch finger 20 for overedge sewing is arranged such that it passes between the needle point 4LH situated on the left with respect to the cloth feed direction (in FIGS. 6 and 7, the upward direction) between the needle point 4CH situated in the central portion, whereas the guide needle piece 21 is arranged such that it passes between the needle point 4RH situated on the right with respect to the cloth feed direction between the centrally-situated needle point 4CH. The present stitch finger 20 and guide needle piece 21 are respectively similar in structure to those employed in a well-known overedge sewing machine and, similarly to those employed in the well-known overedge sewing machine, they are forced into a groove recessed and formed in the front surface of the needle plate 5, and are then fixed there by adhesion.

Also, the stitch tongue 22 is disposed in such a manner that it can be moved outside the right-end-side needle point 4RH with respect to the cloth feed direction (in FIGS. 6 and 7, the upward direction), among the three needle points 4LH, 4CH and 4RH. That is, the stitch tongue 22 is slidably inserted into a groove recessed and formed in the back surface of the needle plate 5, and is structured such that it can be reciprocated along the cloth feed direction. The stitch tongue 22 extends in such a manner that it starts from its leading end portion formed in an arrowhead and turns in a crank-like manner around the right-side needle point 4RH to go toward the front side (in FIG. 6, the lower side) of the cloth feed direction.

Figure 8:
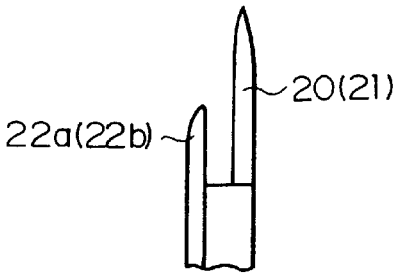
FIG. 8 is an explanatory side view of the needle plate shown in FIG. 6, showing part of the same in an enlarged manner.

Further, as shown in FIG. 8 as well, the crank-like curved portion of the stitch tongue 22 includes a pair of flat sewing thread guide claws 22*a* and 22*b* which are formed integrally with the crank-like curved portion so as to increase the curling amount (length) of a lower thread. The pair of thread guide claws 22*a* and 22*b* are respectively disposed in such a manner that they can project toward the needle falling area at positions respectively just below the above-mentioned stitch finger 20 and guide needle piece 21; and, the thread guide claws 22*a* and 22*b* are also structured such that they can reciprocate together with the stitch tongue 22 and thus they can advance into and retreat from the needle falling area.

Figure 9:
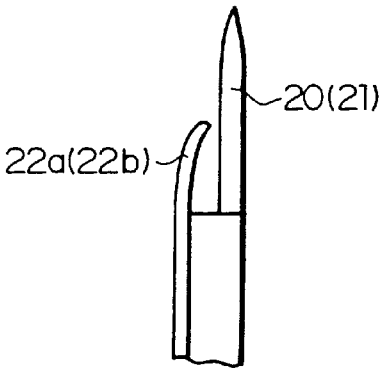
FIG. 9 is an explanatory side view of another embodiment of the structure of the needle plate shown in FIG. 8.

The flat stitch sewing thread guide claws 22*a* and 22*b* are formed such that the lower surface sides of the respective leading end portions thereof are chamfered into curved surfaces, so that the lower thread can be efficiently removed through these curved surfaces. Here, as shown in FIG. 9, if the respective leading end portions of the flat stitch sewing thread guide claws 22*a* and 22*b* are inclined in the upward direction, that is, toward the stitch finger 20 and guide needle piece 21, then the thread can be removed with higher efficiency.

On the other hand, as illustrated in FIG. 6, a first tension plate 23 is pressed against and contacted with the intermediate position of the cloth-feed-direction extending portion of the stitch tongue 22. The first tension plate 23 is also fixed to the back surface of the needle plate 5 by screws 24, while the stitch tongue 22 can be held at a given position due to the elastic pressing force of the first tension plate 23.

Also, in the neighborhood of the end portion of the cloth-feed-direction extending portion of the stitch tongue 22, there is provided a switching knob 25 in such a manner that it can project in the width direction of the needle plate 5. That is, by operating the switching knob 25 back and forth, the stitch tongue 22 can be reciprocated back and forth in the cloth feed direction. By the way, a second tension plate 26 is pressed against and contacted with the intermediate position of the switching knob 25. The second tension plate 26 is fixed to the back surface of the needle plate 5 by the above-mentioned screws 24 together with the first tension plate 23.

Here, as shown in FIG. 6, when the stitch tongue 22 is pushed out in the forward direction (in FIG. 6, in the upward direction), the overedge sewing and flat stitch sewing operations can be executed. On the other hand, as shown in FIG. 7, when the stitch tongue 22 is drawn in to the backward side (in the downward direction) of the cloth feed direction, then the round stitch sewing operation can be carried out.

Now, description will be given below of the types of stitch executable by a overedge sewing machine having the above-mentioned structure with reference to FIG. 10.

In FIG. 10, types of overedge, which are respectively designated by reference numerals 1 to 9 enclosed by round parentheses, are similar to those that are used in the conventional sewing machine. When forming these types of overedge, the three needles 4L, 4C and 4R are used properly in combination and the stitch tongue 22 is moved back and forth properly by means of the operation of the switching knob 25.

Also, a three-needle overedge sewing type designated by reference numeral 10 enclosed by a round parenthesis, is a overedge type which can be realized by the invention. According to the present overedge type, not only the union of three threads obtained by the three needles 4L, 4C and 4R can provide a strong sewing force, but also a contracting action applied on the end of cloth by an upper looper thread and a lower looper thread can prevent the threads from being caught on something, the stitch of the united threads from being cut, the threads from flying out, and the like due to external factors.

Further, in types of flat stitch respectively designated by reference numerals 11 to 13 enclosed by round parentheses as well, similarly to the above-mentioned overedge types, the three needles 4L, 4C and 4R are used properly in combination and a drive mechanism is switched properly by means of the operation of a switching lever 15.

On the other hand, when executing a double-chain stitch type designated by reference numeral 14 enclosed by a round parenthesis, the stitch tongue 22 is moved to the forward side (in FIG. 10, to the upward side) of the cloth feed direction and the needle point 4RH of the right end needle 4R is formed between the present stitch tongue 22 and the round-stitch guide needle 21. And, not only the two members, that is, the stitch tongue 22 and the round-stitch guide needle piece 21 but also the presser foot 8 are sure to be able to hold the cloth. Such sure cloth holding, in turn, prevents the cloth from falling into a needle falling hole when the right end needle 4R passes through the cloth as well as prevents the cloth from being lifted up due to its own resistance when the right end needle 4R rises up from the lower-most position thereof. As a result of this, there can be executed a sewing operation which is free from poor stitch. Such operation and effects can also be obtained similarly in the above-mentioned three-needle overedge type represented by the reference numeral 10 with a round parenthesis.

In this manner, in a overedge sewing machine according to the present embodiment, the overedge sewing operation as well as the flat stitch and double-chain stitch sewing operations can be executed at the same needle position, while the sewing operation can be carried out continuously without changing the needle position.

Especially, in the present embodiment, since there are provided the flat stitch sewing thread guide claws 22*a* and 22*b* for increasing the winding amount of the lower thread, the feeling of the flat stitch sewing can be improved. That is, when the stitch tongue 22 is moved to its operation position, the flat stitch sewing thread guide claws 22*a* and 22*b* are also moved to their respective operation positions, so that the flat stitch sewing thread guide claws 22*a* and 22*b* are situated at positions just below the stitch finger 20 and guide needle piece 21. This increases substantially the winding amount of the lower thread with respect to the stitch finger 20 and guide needle piece 21, which in turn makes it possible that the sewing operation is executed with the lower thread loosened. As a result of this, the quality of the flat stitch sewing can be improved.

Figure 11:
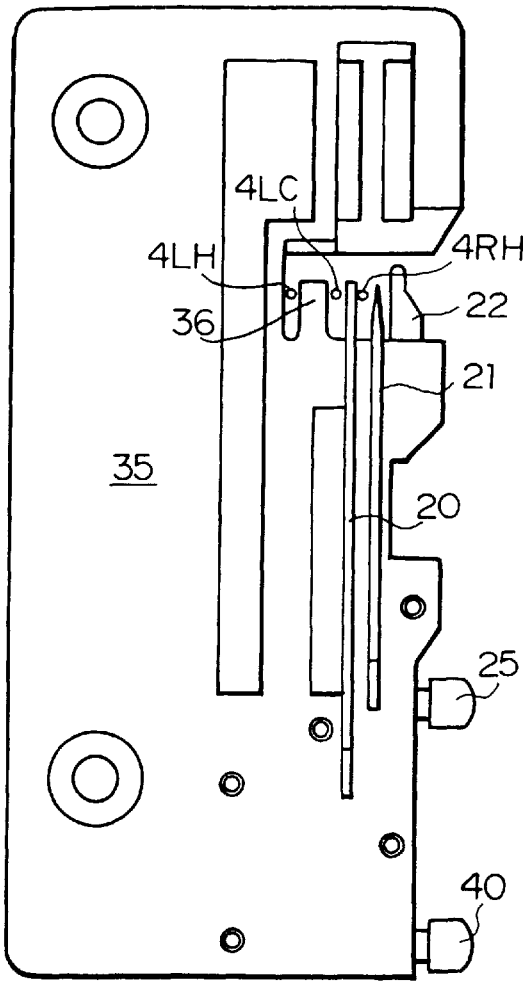
FIG. 11 is an explanatory plan view of the structure of a needle plate employed in another embodiment of a overedge sewing machine according to the invention.

Next, description will be given below of the structure of a needle plate 35 employed in another embodiment shown in FIGS. 11 and 12.

The components of the needle plate 35, which are similar to those of the needle plate 5 employed in the previously described embodiment, are given the same reference characters and thus the description thereof is omitted here, whereas description will be given below of different points between them.

At first, between the needle point 4LH situated on the left side with respect to the cloth feed direction and the centrally situated needle point 4CH, there is provided a guide plate 36 which is formed by extending a portion of the needle plate 35 projectingly in the cloth feed direction. Also, a stitch finger 20 is located between the centrally-situated needle point 4CH and the right-end-side needle point 4RH, whereas a guide needle piece 21 is disposed outside the right-end-side needle point 4RH. Further, a stitch tongue 22 is arranged outwardly of and in parallel to the guide needle piece 21.

Figure 13A:
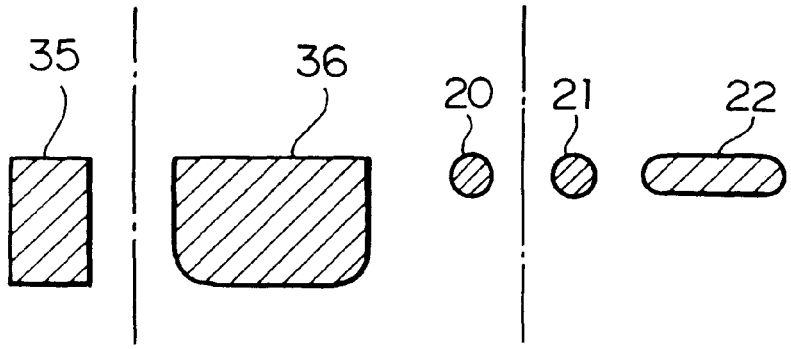
FIGS. 13(*a*) and 13(*b*) are view of a guide plate employed in the invention; in particular, FIG. 13(*a*) is an explanatory transverse section view thereof and FIG. 13(*b*) is an explanatory perspective view of the outer appearance thereof.
Figure 13B:
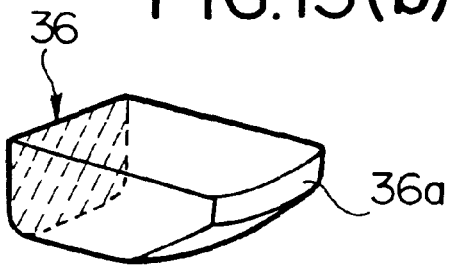

The present guide plate 36, as shown especially in FIG. 13, includes a flat-shaped leading end portion 36*a* and, at the same time, the guide plate 36 is structured such that it gradually increases in thickness from the present flat-shaped leading end portion 36*a* toward the bottom side thereof so as to form a curved surface, and also that it extends on the forward side of the cloth feed direction while the transverse section thereof is substantially formed as a semicylindrical shape.

Also, the stitch tongue 22 is slidably inserted into a groove recessed and formed in the back surface of the needle plate 35, and is also structured such that it can be reciprocated along the cloth feed direction. Further, on the back surface of the needle plate 35, there is mounted a flat stitch sewing thread guide claw 37 which can reciprocate similarly to the stitch tongue 22. The flat stitch sewing thread guide claw 37 is also slidably inserted into the groove recessed and formed in the back surface of the needle plate 35 and is disposed such that it can advance into and retreat from the needle falling area.

Figure 14:
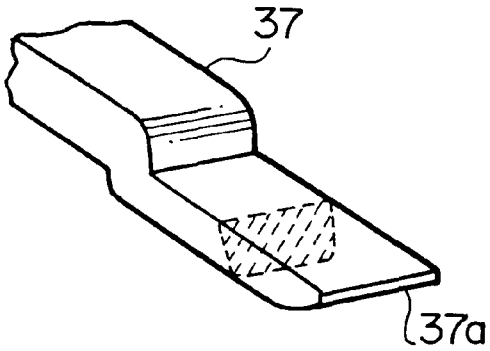
FIG. 14 is an explanatory perspective view of a flat stitch sewing guide claw employed in the invention, showing the shape of the leading end portion thereof.
Figure 15A:
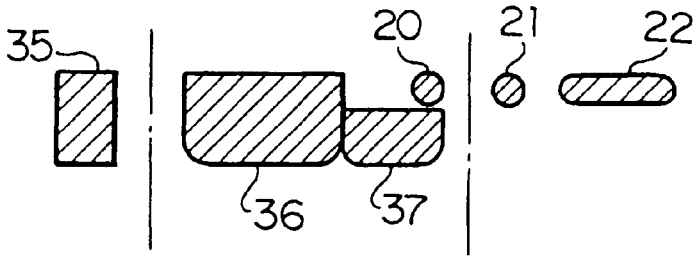
FIGS. 15(*a*) and 15(*b*) are a view of a guide plate employed in the invention; in particular, FIG. 15(*a*) is an explanatory transverse section view thereof and FIG. 15(*b*) is an explanatory bottom view of the back surface side of the needle plate structure employed in another embodiment of a overedge sewing machine according to the invention.
Figure 15B:
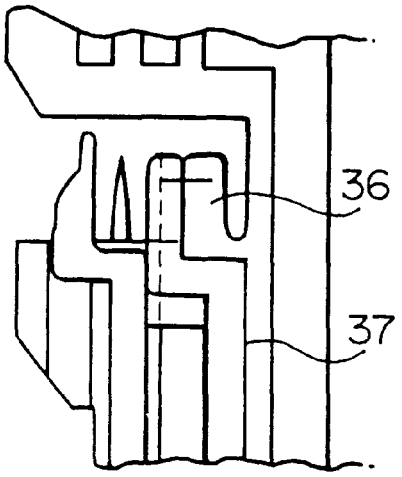

In this structure, as shown especially in FIGS. 14 and 15, the flat stitch sewing thread guide claw 37 is mounted such that the leading end side thereof can slide while keeping in contact with the side wall portion of the guide plate 36 and the lower portion side of the stitch finger 20. And, the upper surface portion and side surface portion of the flat stitch sewing thread guide claw 37, which are respectively to be contacted with the two members 36 and 20, are formed in a flat surface respectively.

Also, the present flat stitch sewing thread guide claw 37 includes a flat-shaped leading end portion 37*a* and, at the same time, the flat stitch sewing thread guide claw 37 is structured such that it gradually increases in thickness from the present flat-shaped leading end portion 37*a* toward the bottom side thereof so as to form a curved surface, and also that it extends on the forward side of the cloth feed direction while the transverse section thereof is substantially formed as a semicylindrical shape. Further, the portion of the flat stitch sewing thread guide claw 37, which extends in the cloth feed direction, is structured such that it includes a given level difference with respect to the leading end portion 37*a* side, is curved in a crank shape along the back surface of the needle plate 35, and extends on the forward side of the cloth feed direction.

Still further, a first tension plate 38 is pressed against and contacted with the intermediate position of the cloth-feed-direction extending portion of the flat stitch sewing thread guide claw 37. The first tension plate 38 is also fixed to the back surface of the needle plate 35 by a screw 39, while the flat stitch sewing thread guide claw 37 can be held at a given position due to the elastic pressing force of the first tension plate 38.

On the other hand, a switching knob 40 is provided on and projected from the end portion of the cloth-feed-direction forward extending portion of the flat stitch sewing thread guide claw 37 in such a manner that it can project in the width direction of the needle plate 35. That is, by operating the switching knob 40, the flat stitch sewing thread guide claw 37 can be reciprocated back and forth in the cloth feed direction. A second tension plate 41 is pressed against and contacted with the intermediate position of the switching knob 40. The second tension plate 41 is formed as an integral body so that it can be connected to the second tension plate 26 corresponding to the switching knob 25 for the stitch tongue 22, and is also fixed by screws 42.

Figure 12:
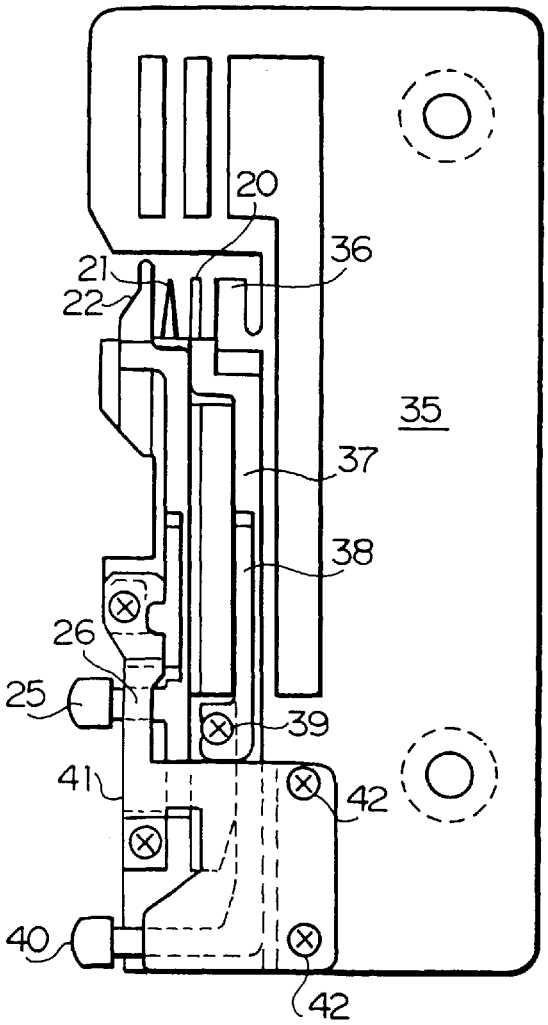
FIG. 12 is an explanatory bottom view of the back surface side of the needle plate shown in FIG. 8.

Referring to FIG. 12, the stitch tongue 22 is pushed out forward and is held in its operation condition and, at the same time, the flat stitch sewing thread guide claw 37 is drawn in backward and is held at its wait condition. In this case, there can be executed a overedge sewing operation and a double-loop stitch sewing operation using a single needle.

Figure 16:
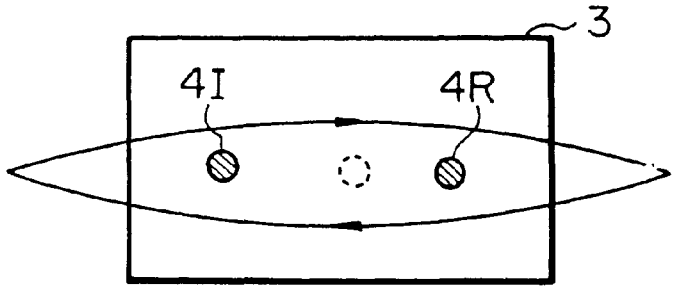
FIG. 16 is an explanatory plan view of a needle, showing how to mount the same when executing the flat stitch sewing operation.

Although a similar seam to the above-mentioned embodiment can be formed even if the needle plate 35 having this structure, as shown especially in FIG. 16, a double-chain sewing needle 4I and a overedge sewing needle 4R are respectively mounted as shown in FIG. 16 with respect to the needle clamp 3 and, at the same time, in the needle plate 35 assembled to the cloth plate, the flat stitch sewing thread guide claw 37 is moved to its operation position shown in FIG. 15(*a*). This fills up a space existing on the lower side of the stitch finger 20 to thereby provide a shape as can be obtained by extending the needle plate 35 substantially in the width direction, which makes it possible to execute the flat stitch sewing operation.

Although description has been given heretofore in detail of the invention developed by the present inventors with reference to the embodiments thereof, it goes without saying that the present invention is not limited to the above-mentioned embodiments but it can be changed and modified in other various manners without departing from the subject matter of the invention.

As has been described heretofore, in a overedge sewing machine according to the invention, the needle point to be used in common with the overedge, flat stitch and double-chain stitch sewing operations is disposed between the stitch tongue and guide needle piece respectively provided in the needle plate, thereby being able to realize the flat stitch and double-chain stitch sewing operations, which makes it possible to switch the types of stitch easily without replacing the needle plate. Thanks to this, not only the burden of an operator is reduced to thereby be able to execute the sewing operation efficiently, but also there is eliminated the possibility that the needle plate can be assembled in a poor manner in replacement thereof, thereby being able to avoid troubles such as needle breakage and the like. As a result of this, the quality of the sewn products can be improved and also, since a replacement part is not required, the cost of the sewing machine can be reduced.

Also, as in a overedge sewing machine according to the invention, if there is provided a flat stitch sewing thread guide claw for increasing the winding amount of a lower thread and a sewing operation can be thereby executed with the lower thread loosened, then the feeling of the flat stitch sewing can be enhanced to thereby obtain an excellent sewing quality, so that the reliability of the sewing machine can be improved further.

What is claimed is:

1. A overedge sewing machine comprising:

means for switching between an overedge sewing operation and flat stitch and double-chain stitch sewing operations;

a needle plate having a stitch finger, a guide needle piece and a stitch tongue reciprocatable between an operation position and a non-operation position outside the stitch finger and guide needle piece; and three needles mounted removably thereon in such a manner that the three needles are arranged in parallel to each other substantially on a straight line, wherein a needle point of the three needles, which is operable with the overedge sewing operation and the flat stitch and double-chain stitch sewing operations is positioned between the stitch tongue and the guide needle piece respectively provided in the needle plate.

2. The overedge sewing machine according to claim 1, wherein the stitch tongue is configured to get around a point where the needle point drops.

3. The overedge sewing machine according to claim 1, further comprising:

a cloth presser member for pressing against cloth at the respective peripheries of the three needles.

4. The overedge sewing machine according to claim 1, further comprising:

a flat stitch sewing thread guide claw for increasing the winding amount of a lower thread.

5. The overedge sewing machine according to claim 4, wherein the flat stitch sewing thread guide claw is disposed such that it can advance into and retreat from a needle falling area on the lower side of at least one of the stitch finger and the guide needle piece.

6. A needle plate for a overedge sewing machine in which drive mechanisms selectively carry out an overedge sewing operation and flat stitch and double-chain stitch sewing operations using three needles mounted removably thereon in such a manner that the three needles are arranged in parallel to each other substantially on a straight line, the needle plate comprising:

a stitch finger;

a guide needle piece; and a stitch tongue reciprocatable between an operation position and a non-operation position outside the stitch finger and guide needle piece, wherein a needle point of the three needles, which is operable with the overedge sewing operation and the flat stitch and double-chain stitch sewing operations is positioned between the stitch tongue and the guide needle piece.

7. The needle plate according to claim 6, wherein the stitch tongue is configured to get around a point where the needle point drops.

8. The needle plate according to claim 6, further comprising:

a flat stitch sewing thread guide claw for increasing the winding amount of a lower thread.

9. The needle plate according to claim 8, wherein the flat stitch sewing thread guide claw is disposed such that it can advance into and retreat from a needle falling area on the lower side of at least one of the stitch finger and the guide needle piece.

* * * * *